US005417032A

United States Patent [19]

Calvert et al.

[11] Patent Number: 5,417,032

[45] Date of Patent: May 23, 1995

[54] CONVERTIBLE FLAP FOLDING MECHANISM

[75] Inventors: Rodney K. Calvert, Dunwoody; Alton J. Fishback, Austell; George R. VanHorne, Atlanta, all of Ga.

[73] Assignee: The Mead Corporation, Dayton, Ohio

[21] Appl. No.: 109,153

[22] Filed: Aug. 19, 1993

Related U.S. Application Data

[63] Continuation-in-part of Ser. No. 6,036, Jan. 19, 1993, abandoned.

[51] Int. Cl.[6] ..... B65B 7/18; B65B 7/20

[52] U.S. Cl. ..... 53/376.4; 53/376.5; 53/376.7; 53/377.2; 53/377.4; 493/156; 493/180; 493/183

[58] Field of Search ..... 53/376.4, 376.5, 376.7, 53/377.2, 377.4, 566, 377.8, 387.2, 374.5; 493/183, 180, 156, 179, 178, 70, 80, 422, 453

[56] References Cited

U.S. PATENT DOCUMENTS

| | | | |
|---|---|---|---|
| 3,416,285 | 12/1968 | Standley et al. | 493/183 |
| 3,504,478 | 4/1970 | Dieter . | |
| 3,602,107 | 8/1971 | Zimmer et al. | 53/377.2 |
| 4,034,658 | 7/1977 | Sherman | 93/49 M |
| 4,460,349 | 7/1984 | Charron | 493/163 |
| 4,480,421 | 11/1984 | Rece | 53/376.5 |
| 4,519,181 | 5/1985 | Sherman et al. | 53/377.4 |
| 4,562,687 | 1/1986 | Green, Jr. | 493/183 |

*Primary Examiner*—John Sipos
*Assistant Examiner*—Rodney A. Butler
*Attorney, Agent, or Firm*—Rodgers & Rodgers

[57] ABSTRACT

A carton having upper and lower end flaps and which is movable along a path of movement is manipulated by a machine having upper and lower rotatable flap folders mountable in either a fixed primary or a movable secondary location. The secondary location being movable in an upstream fashion relative to the direction of carton flow. A driving element and a driving mechanism that moves the secondary folder and rotates it to retain a timed relation with the path of movement of the cartons.

5 Claims, 3 Drawing Sheets

CONVERTIBLE FLAP FOLDING MECHANISM

This is a continuation-in-part of application Ser. No. 08/006,036, filed Jan. 19, 1993, abandoned.

TECHNICAL FIELD

This invention relates to a mechanism for folding the end flaps of cartons used to package consumer products which are dispensed in bottles or cans.

BACKGROUND ART

U.S. Pat. No. 4,480,421, issued Nov. 6, 1984 discloses a flap sealer which responds to a stoppage of a conveyor with glue applied to flaps by shifting the stationary plow and glue nozzles upstream to complete the glue application if necessary and to close the flaps.

According to present practice open ended cartons which are loaded and then closed at their ends with end flaps are manipulated in such a way as to close either the upper end flaps or the lower end flaps initially and then to close the remaining flaps.

According to the prior art, converting a machine adapted to close the carton lower end flaps before closing carton upper end flaps into a machine for folding the upper end flaps before folding the lower end flaps is both expensive and time consuming.

SUMMARY OF THE INVENTION

According to this invention in one form, a carton having upper and lower end flaps and which is movable along a path of movement by flight bars is manipulated by a machine having upper and lower rotary flap folders mountable in either a fixed primary or a movable secondary location, the secondary location being movable in an upstream fashion relative to the direction of carton flow.

A special feature of the invention includes driving means that moves a secondary folder from one position to another and simultaneously rotates the folder in such manner as to retain a timed relation with the movement of flight bars in order to close the final flap onto freshly applied glue.

BEST MODE OF CARRYING OUT THE INVENTION

Figure 1:
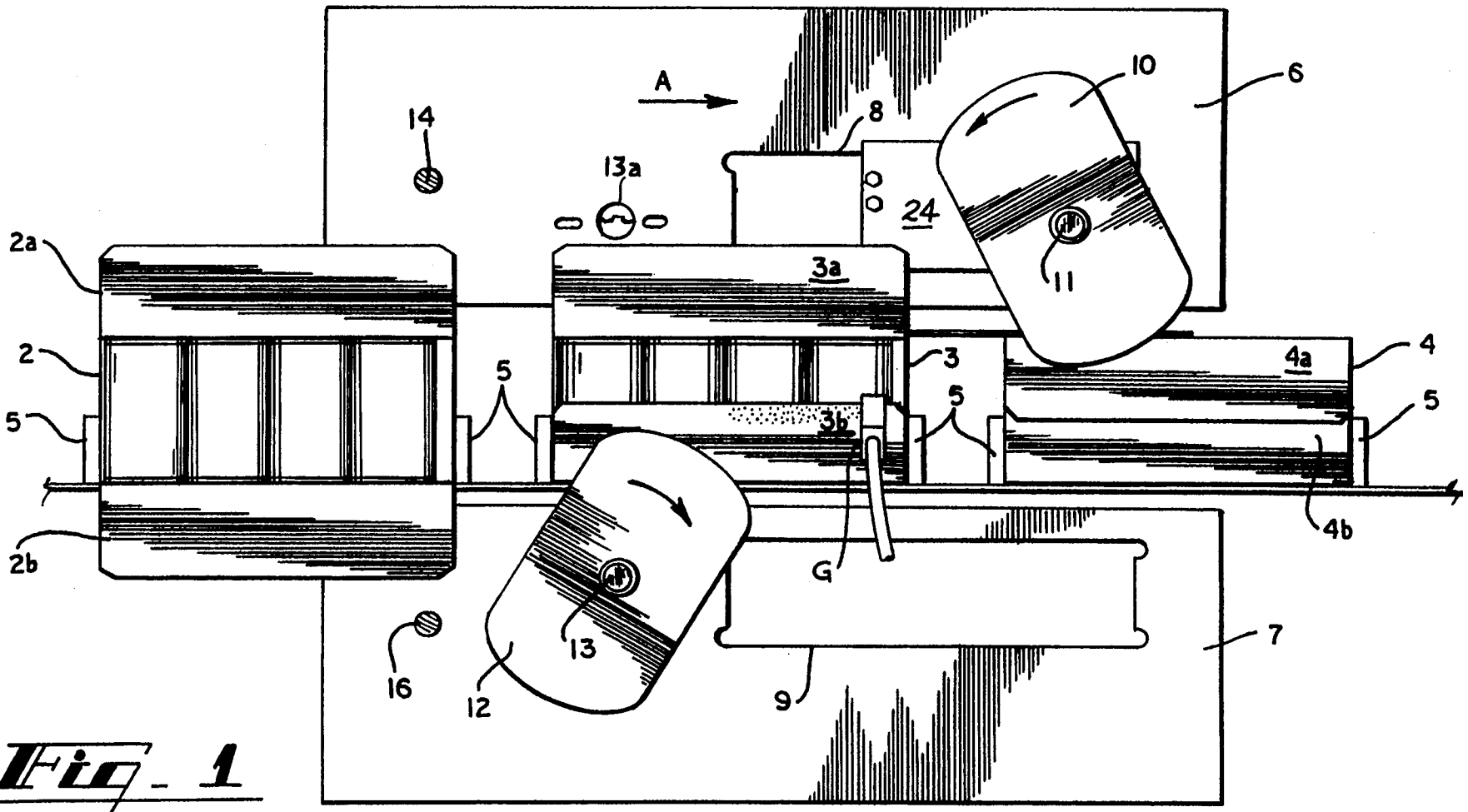
FIG. 1 is a schematic side view of a machine arranged to fold the end flaps of the carton.

In FIGS. 1–4 the path of movement of the cartons from left to right is indicated by arrows A. In FIG. 1 end flaps **2*b*, 3*b* and 4*b* are folded first. A can designated by the numeral 2 is shown entering the flap folding machine. The carton designated by the numeral 3 is shown after upward folding of the lower end flap 3*b* is completed and numeral 4 shows a carton with both of its end flaps 4*a* and 4*b* completely folded in closed positions. Movement of the carton from left to right is effected by flight bars of known construction which are designated schematically by the numeral 5. Of course an application of glue is made to the upper edge portion of panel 3*b* prior to downward folding of upper end flap 3*a***.

For providing mounting means for the cartons and cans during packaging fixed support plates 6 and 7 are provided. Support plate 6 includes an opening 8 while support plate 7 includes an opening 9. As is apparent these openings are elongated and have parallel side edges which are parallel to each other and to the direction of carton flow.

Figure 2:
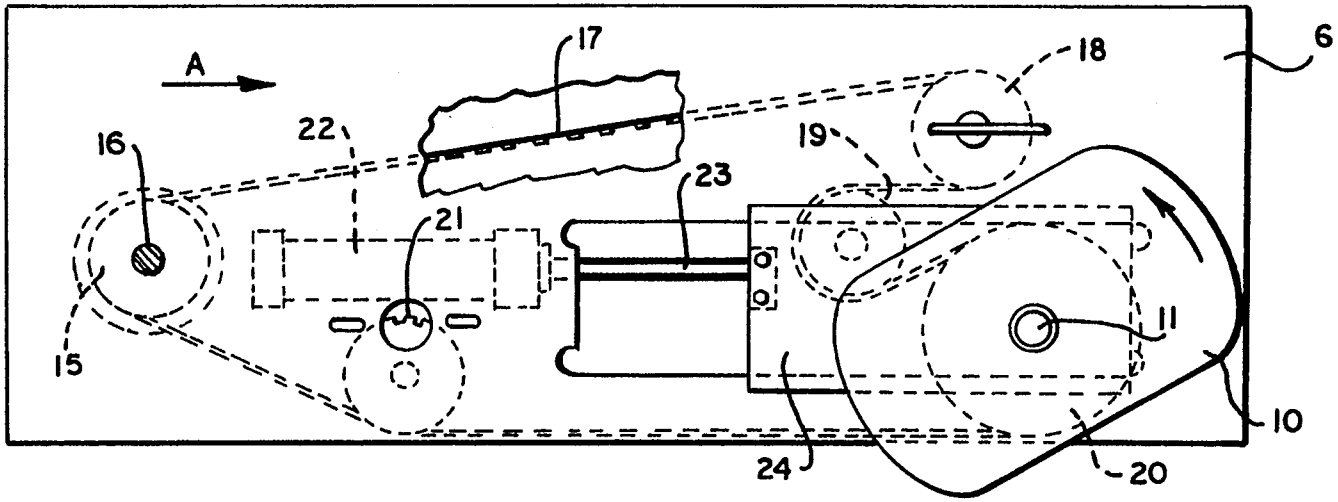
FIG. 2 is a schematic view of cooperating parts of the secondary folder in positions they occupy while the machine is operating.
Figure 3:
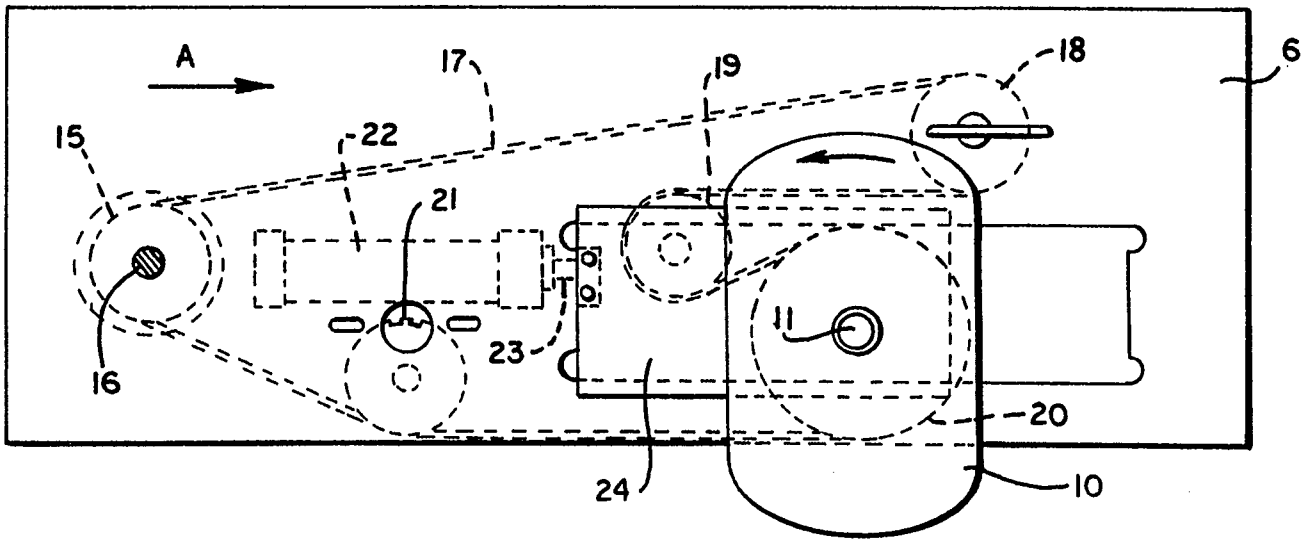
FIG. 3 is a view similar to FIG. 2 but discloses a machine with the secondary folder in its extreme upstream position.

As shown in FIGS. 1, 2 and 3, the lower carton flaps **3*b* are folded first by folder 12 and flaps 3*a* are folded next by folder 10. In order to reverse this sequence, folder 12 is moved from shaft 13 to shaft location 13*a* and folder 10 and its support 24 are mounted in opening 9 in support plate 7**.

For effecting folding operations, flap folder 10 is rotatably mounted on shaft 11 which in turn is mounted on a movable support element 24 a view of which is partially obscured in FIG. 1 due to the overlying folder 10.

Flap folder 12 is mounted on a fixed primary mounting such as shaft 13 supported by plate 7 while rotatable flap folder 10 is mounted on a shaft 11 which in turn is journally mounted on movable secondary support plate 24 which is movable and mounted on support plate 6 and constitutes a secondary location.

FIG. 2 is a plan view of a secondary mounting for flap folder 10 and associated parts including shaft 11.

A sprocket such as 15 having elements such as 21 is mounted on rotatable fixed shaft 16 and rotates to impart movement to endless element 17 which preferably takes the form of projections shown in enlarged condition at 17 and at 21. Endless element 17 cooperates with idler sprocket 18 and with idler sprocket 19 together with sprocket 20 fixedly secured to flap folder 10. The flap folder 10 is mounted on support plate 24 and is movable from an extreme extended position shown in FIG. 2 to a withdrawn position also shown in FIG. 2 and such movement is imparted to the elements by a piston and cylinder arrangement designated by the numeral 22. The piston rod is designated by the numeral 23.

In order to withdraw the folder 10 from its extended position as shown in FIG. 2, appropriate control of cylinder piston device 22 may be effected and as a result the folder 10 is moved from the position shown in FIG. 2 to that shown in FIG. 3. This operation is important because the mechanism automatically moves folder 10 and its support 24 upstream in the event of an interruption of the operation. Upstream movement of folder 10 and of its support 24 closes the final flap on to freshly applied glue. Rotation of folder 10 and upstream movement of folder 10 are effected without changing the timed relation with the flight bars.

As an important feature of this invention, movement from the position represented in FIG. 2 to that represented in FIG. 3 is effected without changing the timing of cooperating parts in any way. It is believed that the portion of endless element 17 which is disposed between tangential positions with respect to idler sprockets 18 and 19 which is located parallel to the sides of support plate 24 constitutes an explanation for the maintenance of timed operation of the mechanism while movement of the secondary folder 10 from the position shown in FIG. 2 to that shown in FIG. 3 is effected.

Figure 4:
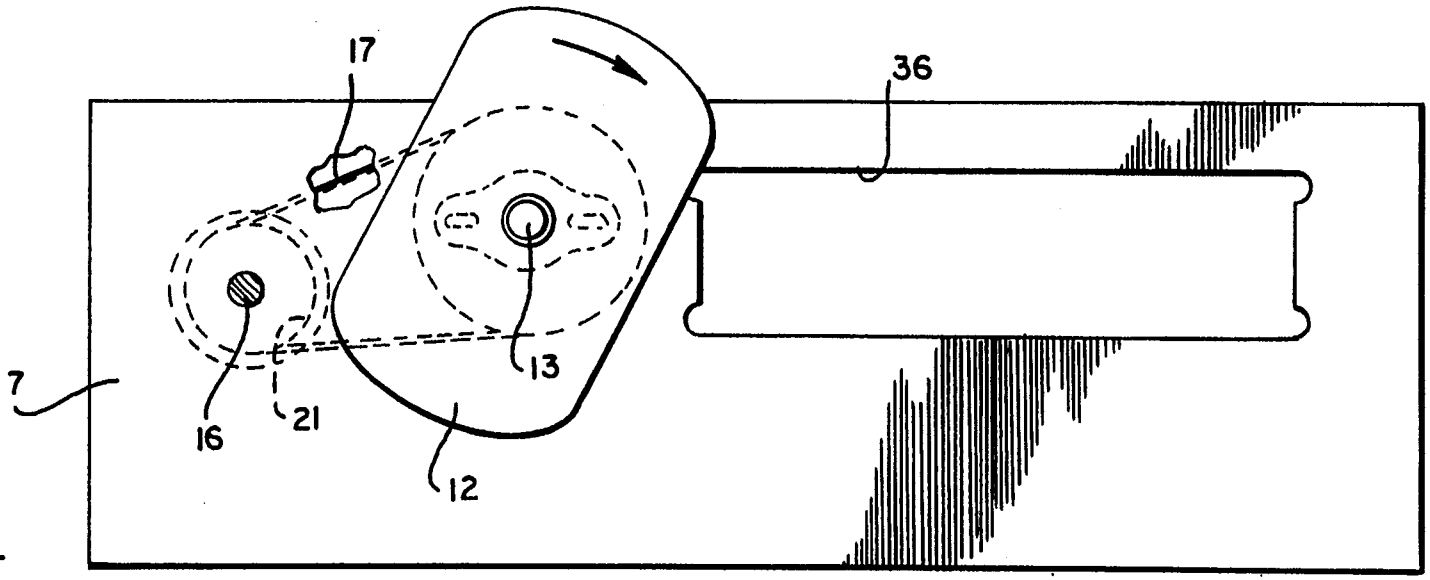
FIG. 4 is a view similar to the lower portion of FIG. 1.

FIG. 4 simply shows structure similar to that shown in the lower part of FIG. 1 but without showing the cartons or their contents. As is apparent folder 12 is rotatable about a shaft 13 which is journalled into support plate 7 by structure indicated in dotted lines about shaft 13.

As depicted in the drawings, the folders incorporate parallel straight side edges and arcuate end edges.

In addition to the movement of the secondary folder 10 as shown in FIG. 2 from its position shown in FIG. 2 to that shown in FIG. 3 by an operation which does not interfere with the timed relationship of the parts is believed to constitute an important aspect of this invention.

In addition this invention facilitates a ready choice as to the sequence in which end flaps are folded, that is, the lower end flap or flaps may be folded first or the upper end flap or flaps may be folded first by means of obvious employment of the features of this invention.

The drawings show folding of the lower end flap first and thereafter the upper end flap. According to this invention, the upper end flap may be folded first. This only requires that folder 12 be mounted on upper support plate 6 at 13*a* and that folder 10 be mounted on support plate 7 so that support plate 24 may slide along aperture 9. Of course the glue applicator G must be properly adjusted in position.

We claim:

1. A mechanism for folding carton end flaps said mechanism comprising means including flight bars for moving cartons along a predetermined path, fixed first and second mounting plates the first of which is disposed below said predetermined path and the second of which is disposed above said predetermined path, a first flap folder rotatably mounted on said first mounting means, a second flap folder rotatably mounted on said second mounting means, said flap folders being directly engageable with said end flaps and each of said mounting means being adapted to receive either of said rotatable flap folders, said first and second rotary flap folders individually mountable in either a fixed primary or a movable secondary location, said fixed primary location comprising said first plate in which the shaft of a rotary flap folder is journally mounted, said movable secondary location comprising said second plate having an elongated opening with spaced side edges parallel to each other and to the path of carton movement, and a folder support element movably mounted in said elongated opening with one of said flap folders mounted on said support element, wherein a rotatable driving element is operably connected with said one of said flap folders by an endless driving element so as to impart bodily movement to said one of said flap folders while maintaining a synchronous timed relation with movement of the flight bars and cartons, and wherein bodily movement is imparted to said one of said flap folders by motive means which imparts reciprocable movement to said folder support element and to said one of said flap folders.

2. A mechanism according to claim 1 wherein a rotary flap folder is mounted on and rotatable with a shaft secured to said movable support element.

3. A mechanism according to claim 1 wherein a first idler element is rotatably mounted on said support element with said endless driving element trained about said first idler element.

4. A mechanism according to claim 3 wherein a second idler element is rotatably mounted on said second support plate.

5. A mechanism according to claim 4 wherein the portion of said endless driving element which is tangentially related with said first and said second idler elements is parallel to the path of movement of said one of said flap folders.

* * * * *